US005720573A

United States Patent [19]

Benedict et al.

[11] Patent Number: 5,720,573

[45] Date of Patent: Feb. 24, 1998

[54] ADJUSTABLE POROUS GROYNES AND METHOD FOR SHORELINE RECLAMATION

[75] Inventors: Charles E. Benedict, Tallahassee, Fla.; L. Clay Spencer, New Orleans, La.; Thomas J. Beggs, IV, Madison, Fla.

[73] Assignee: Beach Reclamation, Inc., Tallahassee, Fla.

[21] Appl. No.: 582,253

[22] Filed: Jan. 3, 1996

[51] Int. Cl.[6] ..... E02B 3/04

[52] U.S. Cl. ..... 405/21; 256/12.5; 405/15; 405/16; 405/32

[58] Field of Search ..... 405/52, 21, 60, 405/63, 70, 71, 72, 32; 256/40, 23

[56] References Cited

U.S. PATENT DOCUMENTS

| | | | |
|---|---|---|---|
| 20,105 | 4/1858 | Tracy . | |
| 227,483 | 5/1880 | Case . | |
| 388,338 | 8/1888 | Bright . | |
| 449,184 | 3/1891 | Solomon . | |
| 1,060,357 | 4/1913 | Nies . | |
| 1,165,906 | 12/1915 | Rhoades | 252/12.5 |
| 1,572,732 | 2/1926 | Cammack | 256/40 |
| 1,635,730 | 7/1927 | Tromanhauser . | |
| 1,646,168 | 5/1927 | Pringle . | |
| 1,716,509 | 8/1929 | Smith . | |
| 1,721,894 | 7/1929 | Abbe . | |
| 1,844,484 | 2/1932 | Smith . | |
| 1,906,442 | 5/1933 | Barrus . | |
| 1,948,639 | 7/1934 | Youngberg . | |
| 1,969,123 | 8/1934 | Doble . | |
| 2,097,342 | 10/1937 | Rehfeld . | |
| 2,135,337 | 2/1938 | Herbest, Jr. . | |
| 2,341,515 | 2/1944 | Rehfeld . | |
| 2,662,378 | 12/1953 | Schmitt et al. . | |
| 2,961,255 | 11/1960 | Trott | 256/23 X |
| 3,426,536 | 2/1969 | Danz . | |
| 3,564,853 | 2/1971 | Csiszar . | |
| 4,118,937 | 10/1978 | Mansen . | |
| 4,688,024 | 8/1987 | Gadde | 405/63 X |
| 4,710,056 | 12/1987 | Parker . | |
| 4,738,563 | 4/1988 | Clark | 405/52 |
| 4,861,193 | 8/1989 | Newkirk . | |
| 5,108,222 | 4/1992 | Jansson et al. . | |
| 5,255,997 | 10/1993 | Bailey et al. . | |
| 5,348,419 | 9/1994 | Bailey et al. . | |

FOREIGN PATENT DOCUMENTS

| | | | |
|---|---|---|---|
| 1300074 | 3/1987 | U.S.S.R. | 256/12.5 |

*Primary Examiner*—Dennis L. Taylor
*Attorney, Agent, or Firm*—Dowell & Dowell

[57] ABSTRACT

A method for shoreline reclamation which includes utilizing groyne structures including stanchions to which are mounted at least one porous screen and wherein the screen is vertically adjustable as material is deposited during the reclamation process.

14 Claims, 6 Drawing Sheets

Fig. 11
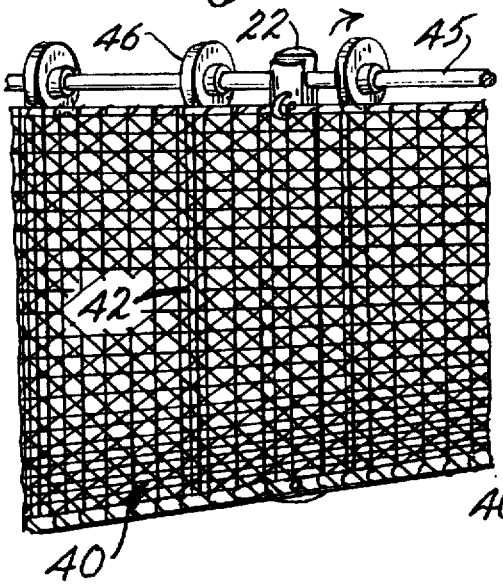
Fig. 12
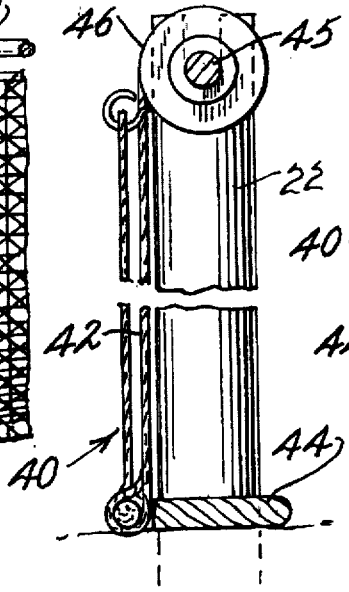
Fig. 13
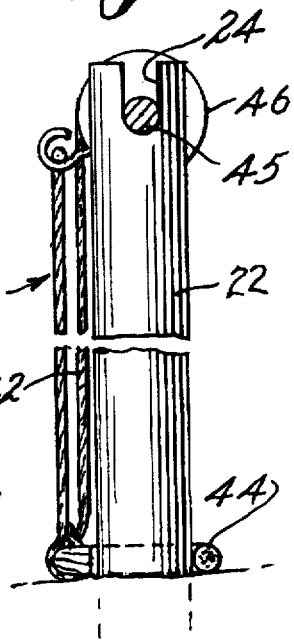
Fig. 14
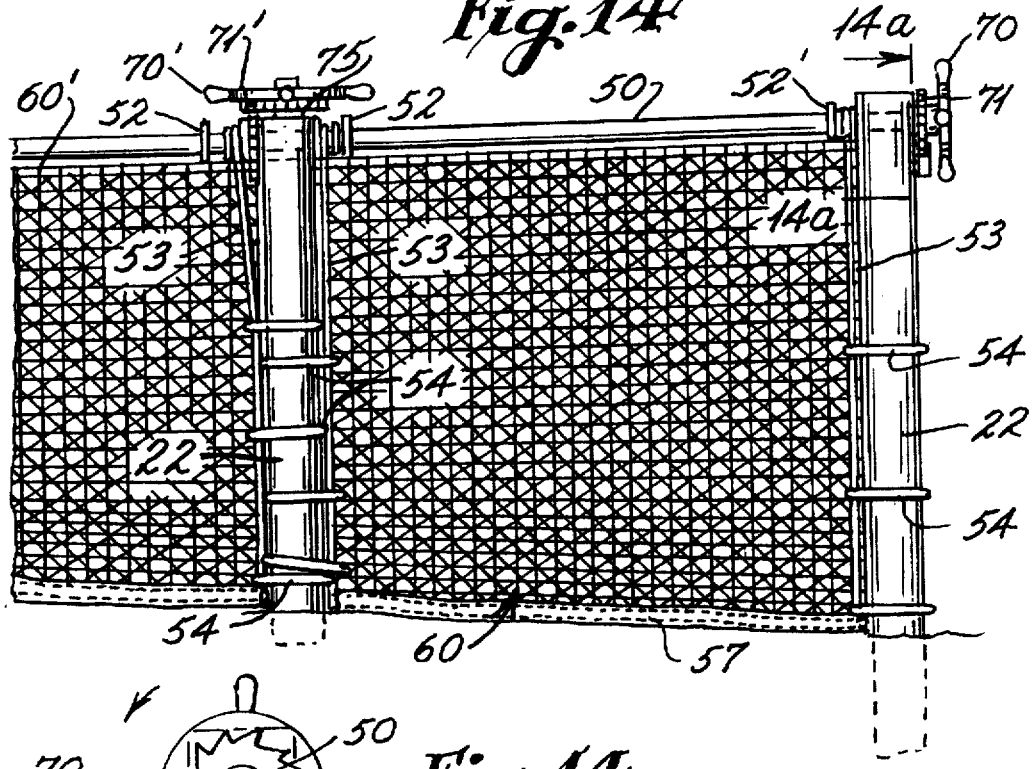
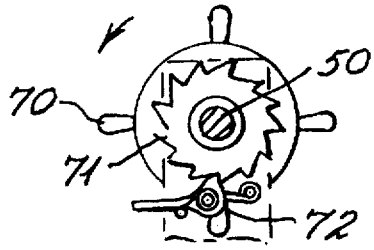
Fig. 14a

ADJUSTABLE POROUS GROYNES AND METHOD FOR SHORELINE RECLAMATION

BACKGROUND OF THE INVENTION

1. Field of the Invention

The present invention is directed to porous groyne structures and method for their use in reclaiming beach and shoreline areas which are subject to erosion by natural forces and, more specifically, to porous groyne structures which are vertically adjustable during use, thereby allowing the porous material of the groynes to be systematically raised as reclamation progresses from the buildup of silt, sand, shells, grasses and other materials.

2. History of the Related Art

Beach and other shoreline erosion, especially in coastal areas, is a major concern to property owners who have residences or establishments which are situated in close proximity to the shoreline. Not only is there a tremendous personal and economic loss caused by damage to, or loss of, real estate, housing and commercial buildings by shoreline or beach erosion, but there is also recreational loss of waterfront property which adversely affects the general public.

To deter coastal erosion in many areas, large seawalls are constructed to prevent high tides from reaching land and property. Such structures are costly and are only practical when population densities make it economically reasonable to construct them. Further, such structures have an adverse effect on the natural appearance of the shoreline and, in many areas, cannot be practically constructed.

Other methods of shoreline reclamation include creating jetties or artificial barriers or reefs which extend from the shoreline. These structures are permanent installations and are generally utilized to prevent sand along coastal areas from washing out to sea by wave action. Like seawalls, however, such structures are costly to construct and maintain and, in some areas, are not appropriate for use due to the shoreline configuration, prevailing currents or tidal activity and the like. Also, such structures create a safety hazard in areas where recreational activity is anticipated.

A further method for reclaiming shoreline areas and preventing further erosion is the placement of off-shore, underwater barriers. Often, large porous structures are placed along a seafloor or riverbed at some distance from the existing shoreline. The structures are provided to break wave, current or tidal action thereby creating a zone of low velocity water flow adjacent a beach or riverbank so that sand, silt and other particulate material will settle out of the water before being conveyed by fluid currents out from the shoreline. Again, such outer barriers are only appropriately used in some locations and are not appropriate for use in many locations and may be objectionable for use in some areas due to the adverse affect on aquatic life.

Other methods which are widely used to reclaim shorelines or beaches are dredging and sand importation. When major dunes along a shoreline are damaged or washed away during heavy storms, it is often necessary to import new dirt and sand to re-establish the dunes to provide a natural barrier to tidal activity. Dredgers are commonly utilized to pump sand from a seafloor or riverbed to build up natural barriers. Such methods of shoreline reclamation, however, are temporary measures at best and do not provide a long-term solution to shoreline erosion. Further, such restoration methods are extremely costly and are not practical in many locations.

In view of the foregoing, there is a need to provide a method and apparatus for economically reclaiming damaged shorelines and beach areas which can be practically used in almost any area without an adverse effect to either land or sea environments. In U.S. Pat. Nos. 1,969,123 and 4,710,056, methods and structures for beach restoration are disclosed which utilize netting for purposes of trapping sand, shells and other particulate matter carried by wave action. Nets are extended outwardly from the shoreline and are left in place until a buildup of sand and other particulate matter is established after which the nets, which may be buried several feet or more in the newly collected material, are withdrawn by winches or other means. The removal of the netting material can adversely affect the restored shoreline by creating trenches or furrows which form natural channels in which water flows away from the shoreline thereby conveying particulate matter back to a body of water.

Other examples of porous shoreline reclamation structures are disclosed in U.S. Pat. No. 227,483 to Case, U.S. Pat. No. 1,060,357 to Nies, U.S. Pat. No. 1,948,639 to Youngberg, U.S. Pat. No. 1,646,168 to Pringle, U.S. Pat. Nos. 2,097,342 and 2,341,515 to Reheld, U.S. Pat. No. 2,135,337 to Herbert, Jr., U.S. Pat. No. 2,662,378 to Schmitt, et al., U.S. Pat. No. 3,564,853 to Csiszar, U.S. Pat. No. 4,861,193 to Newkirk, U.S. Pat. No. 4,118,937 to Mansen, U.S. Pat. No. 4,738,563 to Clark, U.S. Pat. No. 5,108,222 to Jansson, et al., and U.S. Pat. No. 5,255,997 to Bailey, et al.

SUMMARY OF THE INVENTION

The present invention is directed to a method and apparatus for reclaiming shoreline and offshore areas which includes the temporary installation of removable groynes having a plurality of posts or stanchions which are embedded along the shoreline and/or in the seafloor or riverbed in spaced relationship with one another and between which are mounted one or a plurality of porous screens. As used herein, the term shoreline refers to both land and offshore bottom areas including beaches and banks situated along lakes, rivers, inlets, bays, seas, oceans and the like, it being the express purpose of the present invention to build up solid material deposits both on and offshore. The screens may be formed of any suitable materials having a plurality of openings therein and, in preferred embodiments, are formed of flexible elements such as chain link, conventional netting, geo-textiles, expanded plastics, nylon meshes, knitted and woven fabrics and the like. In some embodiments, the openings may be created in somewhat non-flexible materials such as open slatted wooden or plastic structures.

The screens are supported relative to the stanchions and extend to lower edges which are designed to rest on the material forming the shoreline. The groynes further include means for periodically and systematically elevating the lower portion of the screens to thereby prevent the screens from being embedded within newly deposited particulate material. Such means may include rods or take-up reels upon which the screens may be rolled or collected utilizing either manual or motor operated hoisting or winch-like devices. The hoist or winch devices may be mounted at a common point for each groyne or may be separately attached to spaced stanchions along a single groyne.

Utilizing the methodology of the present invention, a plurality of spaced groynes are temporarily positioned so as to extend outwardly from the shoreline in spaced relationship with respect to one another. The orientation between the groynes and their angular relationship with respect to the shoreline will be dictated by the specifics of a given area and the currents, tidal activity and winds in the area. Once the screen or screens have been vertically secured to the spaced stanchions, the lower portions of the screens are periodically elevated so as to remain generally in line with the upper surface of material being deposited along the length of the groyne so that the lower edges of the screens are not significantly embedded within the newly deposited material. After an area has been reclaimed, the screens are easily removed without disturbing the contour of the shoreline.

It is a primary object of the present invention to provide a method and apparatus for economically reclaiming land along shorelines and offshore areas of oceans, gulfs, inlets, bays, rivers, lakes as well as other areas where currents and tidal and/or wind activity is experienced.

It is a further object of the present invention to provide groyne structures and a method for installing groyne structures along shorelines in such a manner that the groynes may be temporarily installed and removed after land has been reclaimed without disturbing the natural contour of the reclaimed land.

It is yet a further object of the present invention to provide groyne structures which may be utilized to reclaim land along a shoreline which are environmentally compatible and which may be continuously adjusted so as to not adversely affect the buildup of deposited materials.

BRIEF DESCRIPTION OF THE DRAWINGS

The invention will be best understood with reference to the accompanying drawings wherein:

FIG. 11 is a rear partial perspective view of the embodiment of FIG. 9 showing the porous screens extending in front of one of the vertical support stanchions;

FIG. 12 is an enlarged cross-sectional view taken along line 12—12 of FIG. 10;

FIG. 13 is an enlarged cross-sectional view taken along line 12–13 of FIG. 10;

FIG. 14 is a perspective view of another embodiment of the present invention showing control lines for raising the groyne screens as they extend through guide rings mounted about the support stanchions of the invention;

Figure 15:
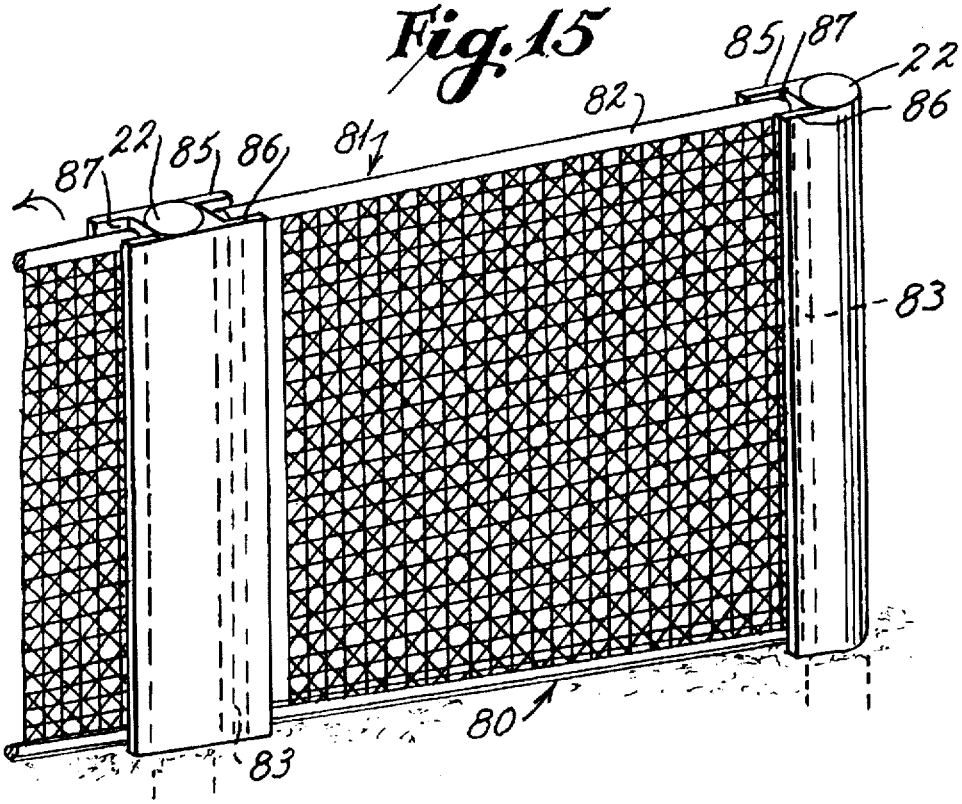
Figure 16:
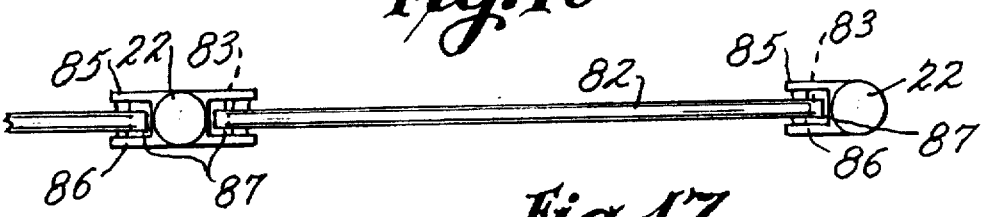
Figure 17:
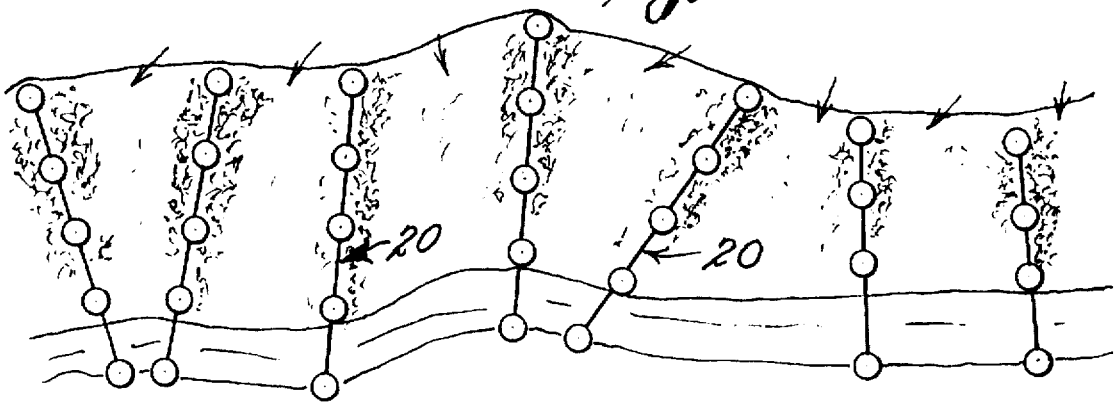
Figure 18:
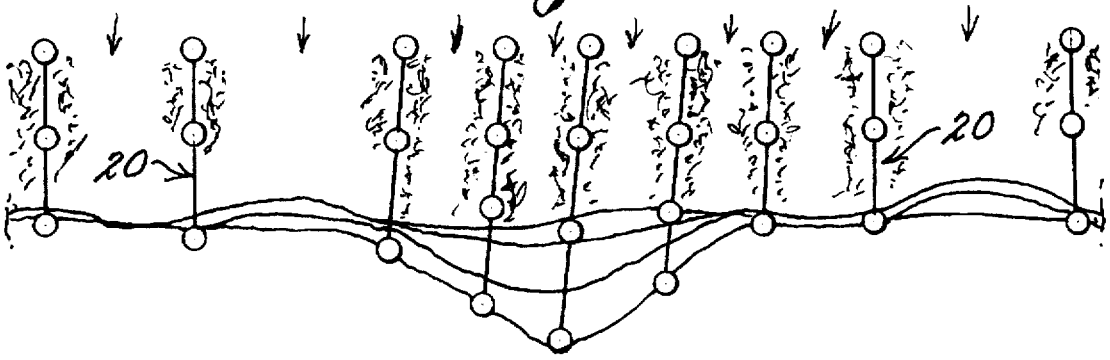
Figure 19:
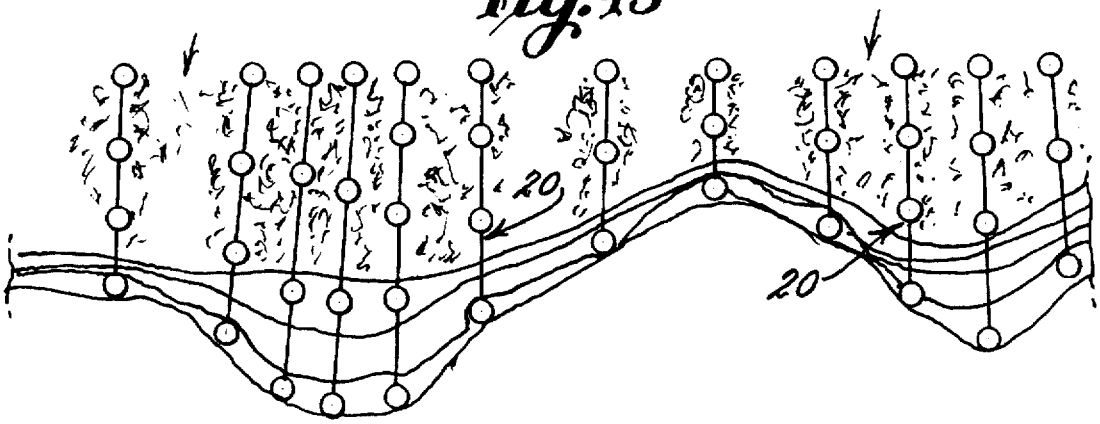
Figure 20:
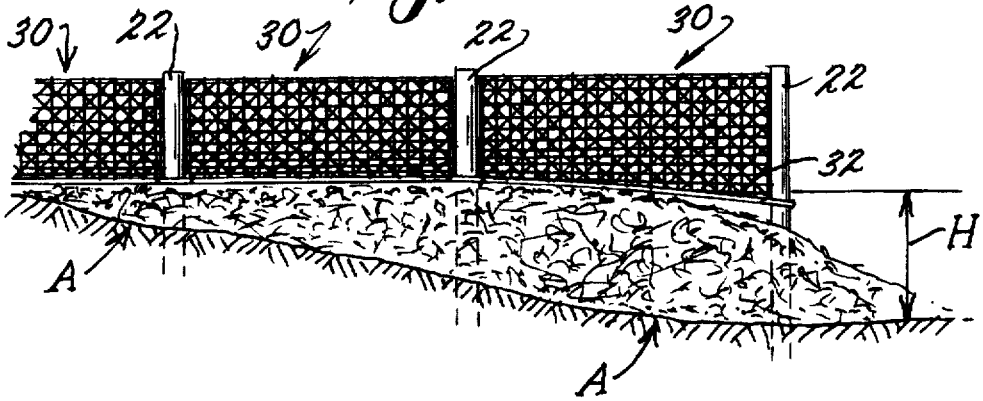

FIG. **14*a* is a view taken along lines 14*a*—14*a* of FIG. 14**;

FIG. 15 is a partial perspective view of yet another embodiment of the present invention showing a porous groyne screen constructed as a generally rectangular member which is vertically elevated within channels associated with the support stanchions;

FIG. 16 is a top plan view of the embodiment shown in FIG. 15;

FIGS. 17, 18 and 19 are top illustrational views showing the arrangement and orientation of a plurality of porous groynes utilized in accordance with the teachings of the present invention as they are oriented outward along a shoreline;

FIG. 20 is a perspective illustrational view showing the porous screens of one of the groynes of the present invention in a raised position after initial material deposits have been created by the placement of the groyne along a shoreline.

DESCRIPTION OF THE PREFERRED EMBODIMENT

With continued reference to the drawing figures, the present invention will be described in use for the reclamation of shorelines along bodies of water which are subject to natural erosion by waves, currents, tidal activity and wind. The porous groynes may be utilized in substantially any environment where it is desired to reclaim material for the buildup of landmasses adjacent any body of water.

Figure 1:
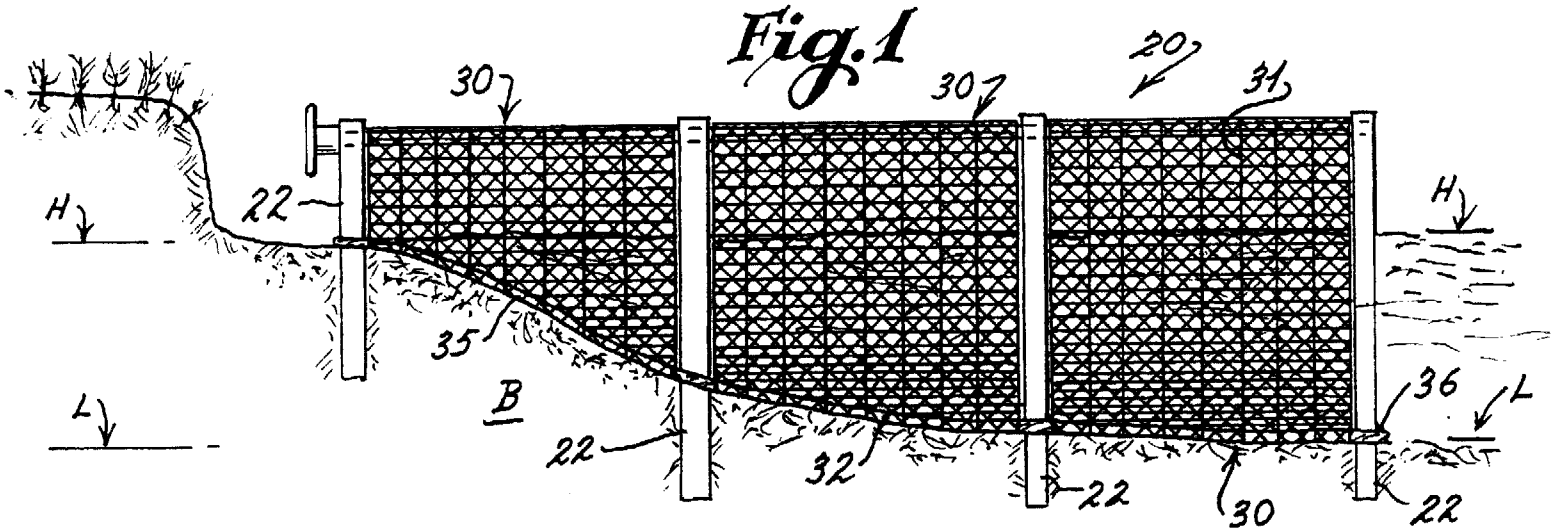
FIG. 1 is a side-elevational view of a first embodiment of porous groyne showing a plurality of porous flexible screens installed between vertical stanchions and wherein the screens may be periodically raised.

With specific reference to FIG. 1, a first embodiment of porous groyne structure 20 is shown placed so as to extend outwardly into a body of water. In the drawing figure, the high water or high tide line is generally designated at "H" and the low water or low tide line at "L". The structure may extend offshore into the body of water a preselected distance and normally will extend outwardly beyond the low tide line. The structure includes a plurality of horizontally spaced posts or stanchions 22 which are formed from an appropriate material such as galvanized steel or heavy plastic pipe and which are embedded into the floor of the body of water and along the shoreline. Each stanchion is embedded a sufficient distance to support the structure during its period of use.

Figure 4:
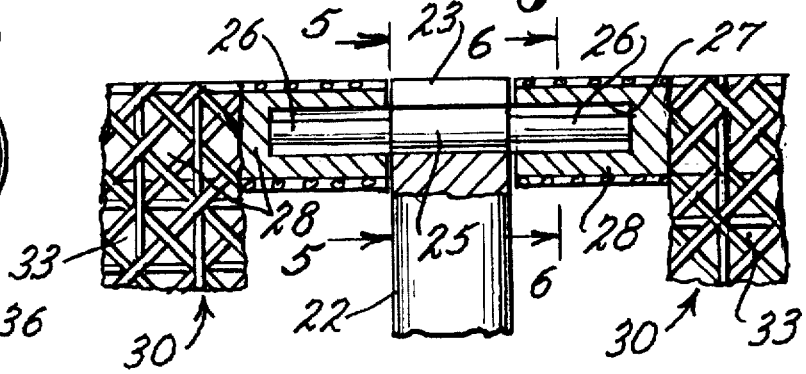
FIG. 4 is an enlarged cross-sectional view taken along line 4—4 of FIG. 2.
Figure 5:
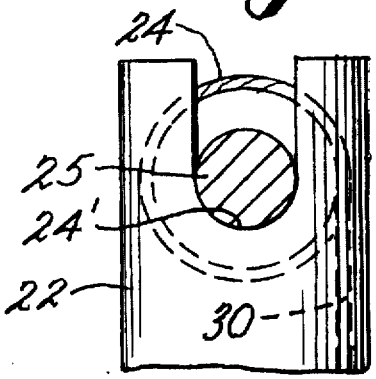
FIG. 5 is an enlarged cross-sectional view taken along line 5—5 of FIG. 4.
Figure 6:
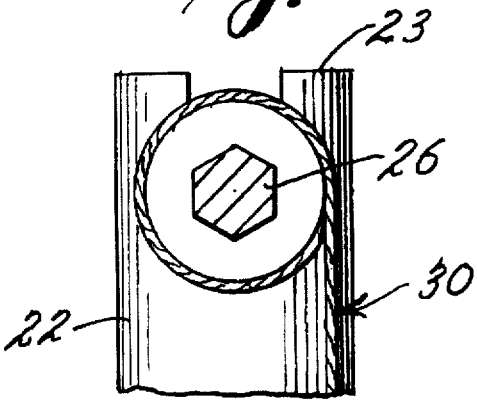
FIG. 6 is an enlarged cross-sectional view taken along line 6—6 of FIG. 4.

With specific reference to FIGS. 4 through 6, the upper end 23 of each stanchion includes a recessed portion 24 in which is cradled a stub shaft 25. The recesses 24 form bearing surfaces 24' for supporting a circular cross-section of the stub shafts 25. The stub shafts also include outwardly extending profiled end portions 26 which are shown as being hexagonal in configuration but may be of other cross-sectional configurations or splined. The portions 26 are designed to fit within cooperatively configured channels 27 formed in the ends of horizontally extending support rods 28. A separate rod 28 is preferably mounted between each of the stanchions 22.

Mounted to each rod 28 is one or more porous screens or panels 30. Each screen or panel includes an upper portion 31 which is secured to a support rod 28 by suitable fasteners (not shown) and includes a lower portion 32 which extends down into contact with the shoreline material or floor or bed "B" of the body of water. The screens 30 are designed to permit fluid and small particles to pass therethrough but to block the passage of various larger solids. In this respect, each screen may be formed of a chain link material, conventional netting materials, geo-textiles, expanded plastics, nylon meshes, cotton knitted or woven mesh fabrics or other generally flexible porous materials. Openings 33 formed in the material need not be uniform throughout each screen and may vary in dimensions from the lower portion of the screen adjacent the bottom edge upwardly towards the upper portion 31. The screens are designed to obstruct larger particles carried by the water and further reduce the flow velocity so that particles tend to settle out of the water and collect adjacent the lower portion 31 of each screen.

To facilitate the manipulation and guidance of the screens 30 as they are being raised and wound about the support rods 28, a rope or cable 35 may extend through the screen material along the lower portion thereof. The rope or cable may include looped portions 36 which surround the stanchions 22 and function as guides to retain the screens taut as they are raised.

Figure 2:
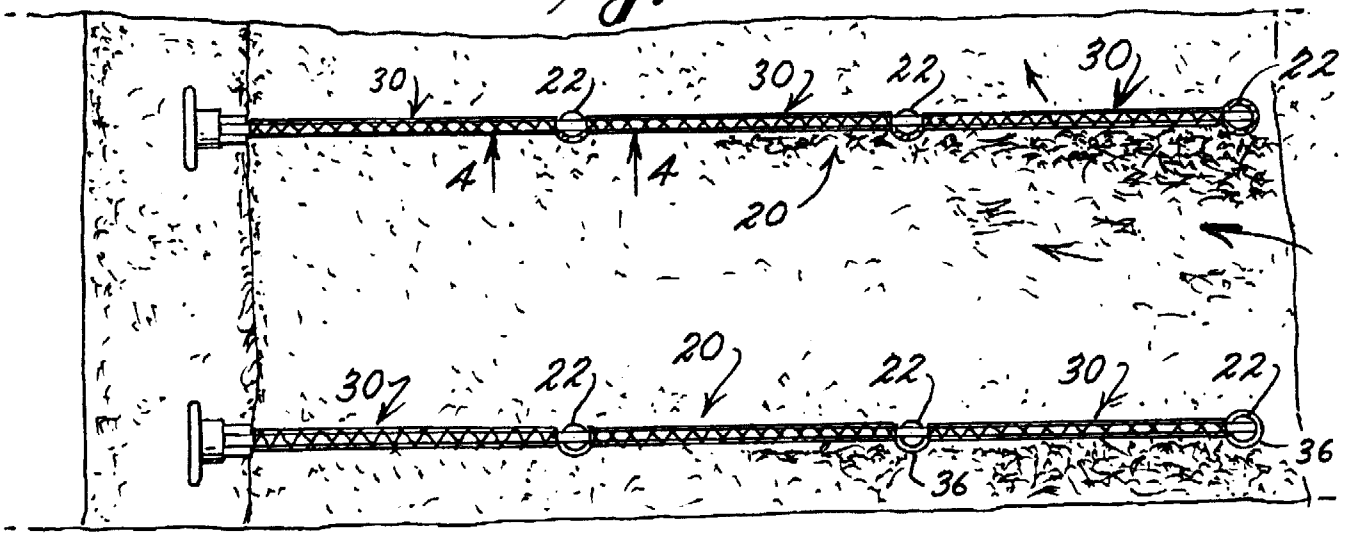
FIG. 2 is a top plan view of a pair of porous groyne screens of FIG. 1 showing the flow of water by arrows as material is deposited adjacent the upstream side of the screens.

As shown in FIG. 2, by aligning a plurality of groynes in adjacent relationship with respect to one another along a shoreline, it is possible to reduce the energy of water flow through the screens to cause the settlement of solids. The groynes are spaced apart by an appropriate distance determined by terrain, tidal activity, winds, suspended particle sizes, water currents and turbulence and other parameters. Particles may pass through more than one groyne before settling out because of the spacing of the openings in the screens. Further, the angular relationship between the groynes and the shoreline may vary from a generally right angle, as shown in FIGS. 2, 18 and 19, to other angles, as shown in FIG. 17, depending upon various natural parameters.

Figure 3:
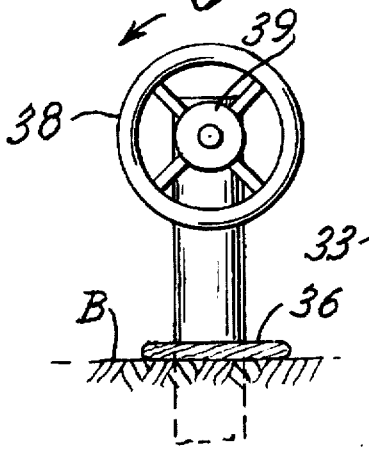
FIG. 3 is an enlarged end view of a control crank for raising the groyne screens shown in FIGS. 1 and 2.

During the use of the groynes of the present invention, as materials begin to build up along the lower portion of each of the porous screens, the screens are intermittantly raised so as not to disturb the buildup of material along the shoreline. To accomplish this, and as shown in FIGS. 1 and 3, in one embodiment, the screens 30 may be wound on the support rods 28. A handwheel 38 is mounted to a drive hub 39 having an opening for receiving the profiled end 26 of one of the stub shafts 25. By rotating the handwheel 38 in the direction shown by the arrow in FIG. 3, the rods 28 are simultaneously rotated in a counter-clockwise manner winding the screens 30 about the rods 28. An appropriate ratchet or other locking mechanism (not shown) may be utilized to secure the handle 38 in an adjusted position to prevent the inadvertant unwinding of the screens.

Figure 7:
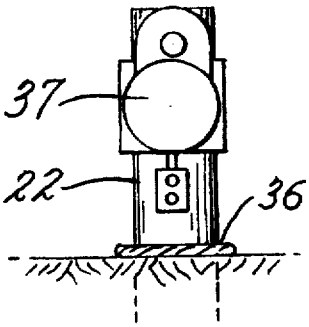
FIG. 7 is a view similar to FIG. 3 except showing a powered motor for winding the porous screens of FIGS. 1 and 2.
Figure 8:
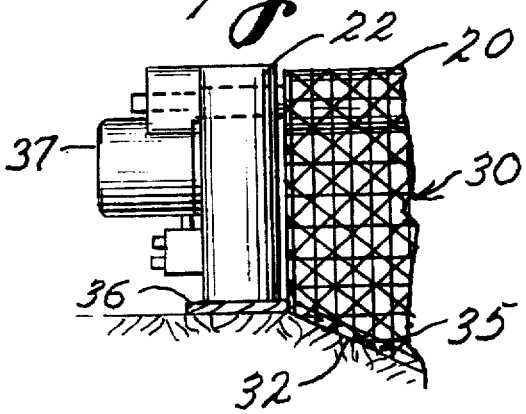
FIG. 8 is a side elevational view of the motor assembly of FIG. 7.

As will be discussed hereinafter, it is also possible to mount a hand crank along the upper portion of each stanchion and, by appropriate gearing, allow for the selective winding of each of the screens 30 independently of one another by rotating an associated rod 28. In this manner, the variation in elevation of the bottom portions 32 of each screen may be selectively altered depending upon the amount of material buildup. Further, as shown in FIGS. 7 and 8, as opposed to utilizing a manual crank for winding the screens on the rods 28, an appropriate gasoline, hydraulic or other appropriately powered motor 37 may be mounted to the innermost stanchion 22'. The motor may be selectively activated to rotate the rods 28 in a manner as previously discussed with respect to the embodiment shown in FIGS. 1 and 3.

As shown in FIG. 1, it is preferred that an excess of the screen material be deployed adjacent the material defining the shoreline or the floor or bed of the body of water in order to facilitate the initial deposit of particulate material.

Figure 9:
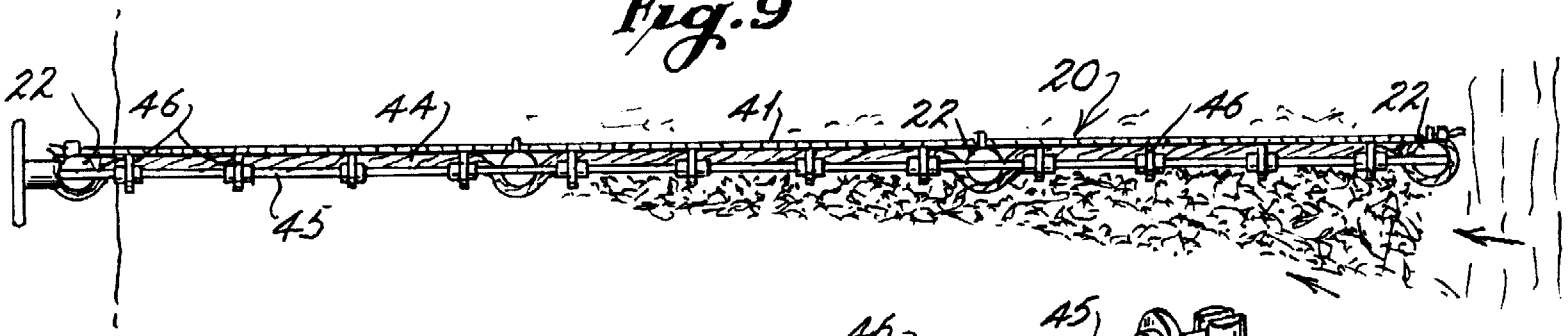
FIG. 9 is a perspective view of a second embodiment of the present invention showing an alternate means for raising the porous groyne screens.
Figure 10:
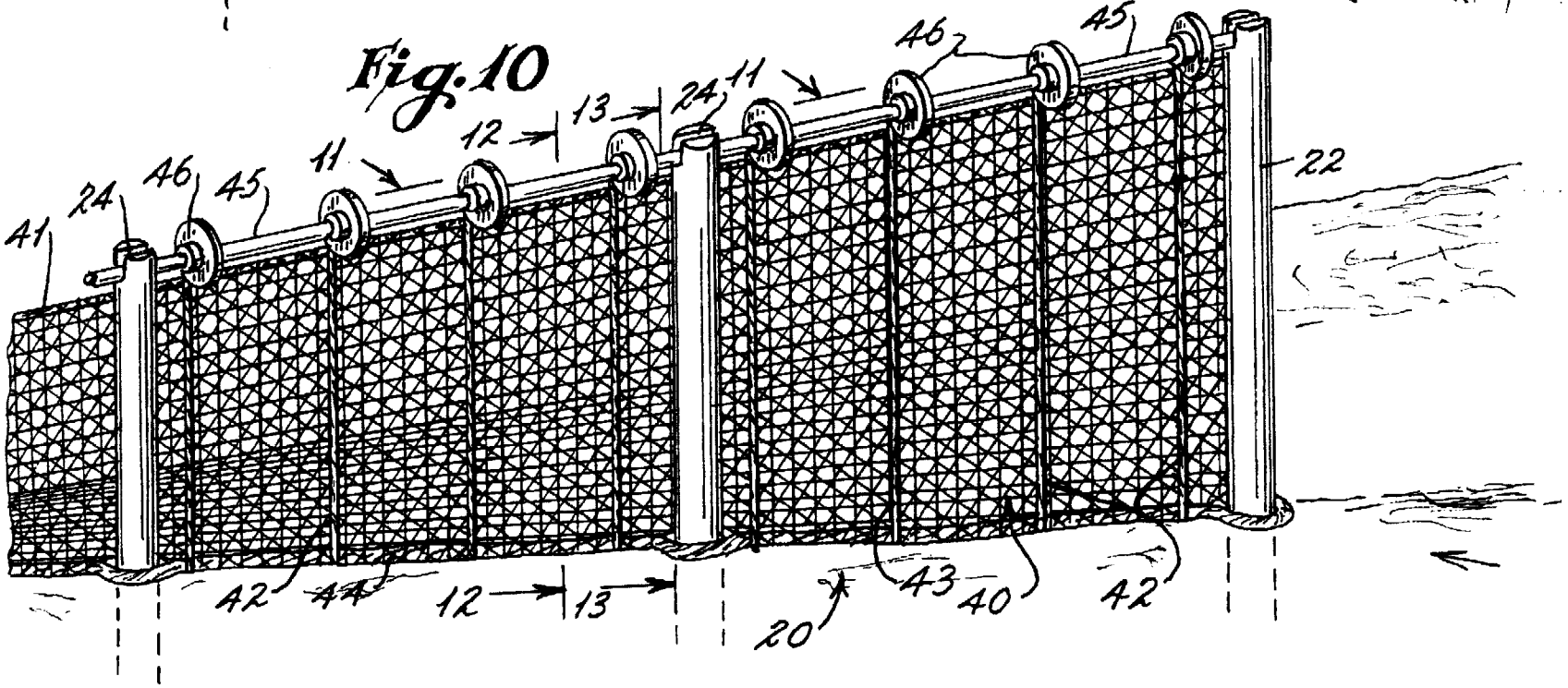
FIG. 10 is a top plan view of the embodiment of FIG. 9.

With particular reference to FIGS. 9 and 10, a second embodiment of the invention is disclosed in greater detail. In this embodiment, each of the groyne sections or screens 40 are mounted to similar stanchions 22 as disclosed with respect to the embodiment shown in FIGS. 1 through 8. However, in this embodiment, the screens are constructed as a continuous porous material and not sectioned between the stanchions. The upper portion 41 of the porous screen material is also not directly mounted to any horizontal support member but rather the screen is secured along its upper edge to the spaced stanchions. The screen includes a plurality of vertically extending tapes or cords 42 which are fixed at their lower ends to the lower portion 43 of the screen which, in this embodiment, is supported by an elongated rope or cable 44. As shown in FIG. 9, the cable extends on an opposite side of each of the stanchions from the porous screen material so as to provide guides for stabilizing the porous screen as it is raised.

To raise the porous screen 40, one or more support rods 45 are mounted in the bearing portions of the recesses 24 formed in the upper end of each stanchion. The rods 45 are connected at the innermost stanchion to either a hand crank mechanism, as previously discussed with respect to the embodiment of FIG. 3, or a powered motor, as shown in FIGS. 7 and 8. Mounted in spaced relationship along the length of the rod or rods 45 are a plurality of take-up reels or spools 46 which are keyed to the rods 45 so as to rotate therewith. The upper portion of each tape 42 is connected to a corresponding take-up reel 46 so that as the rod 45 is rotated, the tape will wind about the take-up reel, raising the rope or cable 44 extending along the lower portion of the screen. The elevation of the screen is therefore accomplished by winding the tapes 42 onto the reels, however, the upper portion 41 of the screen remains ungathered as the lower portion is gathered as it is raised.

With particular reference to FIGS. 14 and 14*a*, another embodiment of the present invention is disclosed in greater detail. In this embodiment, the stanchions are essentially the same as those disclosed with respect to the previous embodiments. In this embodiment, there is also provided one or more support rods 50 which are connected in end-to-end relationship and which extend into the bearing portions of each of the upper ends of the stanchions 22. Mounted adjacent each stanchion are one or two take-up reels 52 which are utilized to wind cables or ropes 53 which extend from the reels 52 downwardly through one or more guide rings 54 which are slidable about the stanchions. The rings may be formed of any suitable material such as plastic, metal or fabric and are designed to guide the cables 53 from one end connected to one of the take-up reels 52 to an opposite end which is connected to a spaced take-up reel 52' mounted adjacent a spaced stanchion. Each cable 53 therefore extends vertically downwardly through the guide rings 54 of one stanchion, across the lower portion 57 of a porous screen 60 and up through the guide rings 54 of a spaced stanchion to a spaced take-up reel 52'.

In this embodiment, the porous screens 60 are formed as separate panels, as was the case with the embodiment shown in FIGS. 1 through 8. As material is deposited along the base of each of the porous screens, each cable 53 is progressively wound upon take-up reels 52 and 52' utilizing either a hand or motor operated crank mechanism, similar to those discussed with respect to the previous embodiments, thereby elevating the lower portion of the screens with the guide rings 54 guiding the edges of each screen as it is raised.

As opposed to utilizing a single hand crank or motor mechanism for winding the take up reels of any of the embodiments, it is also possible to use separate motors or hand cranks which are mounted to each of the stanchions for controlling the elevation of the various screens. Screen 60 is controlled by a hand crank 70 which is mounted to the support rod 50. The hand crank includes an associated ratchet mechanism 71 having a locking device 72 associated therewith for preventing the reverse movement of the hand crank after the screen 60 has been elevated by rotating the support rod 50. In a like manner, a hand crank 70' is mounted to the adjacent stanchion for controlling the raising of the lower edge of the adjacent screen 60'. In this embodiment, the hand crank 70' also includes an appropriate ratching mechanism 71' mounted to support rod 50'. The ratchet mechanism is driven by engagement with a gear 75 associated with the hand crank 70'.

With continued reference to FIGS. 15 and 16, another embodiment of the present invention is shown in greater detail. In this embodiment, the porous screens 80 are not designed to be rolled or gathered to adjust for deposited material. Rather, the screens are designed to be vertically elevated by mounting the screens within sliding frames 81. Each frame includes horizontal and vertical members 82 and 83, respectively. The screen material is secured to the frame by any suitable fasteners. The screen material, in this embodiment, may be relative inflexible, such as wood or plastic slats or may be a pliable material as previously described. As shown, the lower portion or edge 84 need not include a frame component. The stanchions 22 need not include any type of upper bearings and are shown as including oppositely oriented spaced channel members 85 and 86 which form guide slots 87 in which the vertical frame members 82 are guided. Although not shown in the drawing figures, the vertical and horizontal members may be joined to one another so that each frame may be somewhat articulated at the corners to thereby allow an oblique shifting of the frame 81 relative to the channel members associated with each stanchion. In this manner a screen may be elevated to differing heights on opposite sides to account for different contours along the shoreline. As with the previous embodiments, as material is deposited, the screens are raised within the channel members. The lower edge of each screen is subsequently rested on the collected material until new material is deposited at which time each screen is again selectively raised. Although not shown, hoisting devices may be used to raise each frame 81.

With specific reference to FIGS. 17 through 19, several orientations for the deployment of the porous groynes of the present invention are shown. In FIG. 17, some of the groynes extend generally perpendicular outwardly from the shoreline into a body of water whereas other of the groynes are acutely angled relative to the shoreline. The action of waves along a beach is indicated by the arrows in the drawing figures. The orientation of the porous groynes will be determined based upon the particular contour of an area being reclaimed. In FIGS. 18 and 19, the porous groynes are shown as being generally parallel with one another with the spacing between groynes being varied.

FIG. 20 is an illustration showing the manner of which the groynes of the present invention are elevated as material is deposited along a beach. The original contour of the shoreline is shown by solid line "A". After a period of time with the groynes in use, material is deposited to a height "H". The screens 30 are thereafter raised so that the lower edge 32 rests along the upper portion of the material. If the groynes are not raised as material is deposited, any attempt to remove the screens will result in the formation of troughs along the reclaimed surface material which troughs adversely affect the manner in which the reclaimed material remains on the shoreline. Therefore, the lower portion of the screens are intermittantly raised so as to preserve with the newly formed contour of the shoreline.

What is claimed is:

1. A method of reclaiming land along a shoreline or offshore by causing the deposit and retention of particulate material utilizing a plurality of spaced groynes, each groyne including a plurality of spaced stanchions which support at least one screen means having upper and lower portions and side edges, and the at least one screen means being elevatable with respect to material being deposited and wherein the screen means is formed having a plurality of openings therethrough through which water will flow and cause the particulate material to deposit but which are of the size to prohibit passage of larger solid material carried in tidal currents comprising the steps of:

a) placing the stanchions in spaced relationship relative to one another extending from the shoreline or offshore;

b) mounting the at least one screen means to the spaced stanchions so that the lower portion thereof is engageable with the shoreline or offshore to thereby create a buildup of newly deposited solid materials adjacent the lower portion thereof;

c) preserving the buildup of newly deposited solid materials by periodically elevating at least the lower portion of the at least one screen means so that the lower portion thereof is maintained substantially at the height of newly deposited solid materials.

2. The method of claim 1 in which said lower portion of said at least one screen means is elevated by gathering the lower portion vertically upwardly toward the upper portion.

3. The method of claim 2 including guiding said edges of the at least one screen means vertically upwardly along the stanchions as the lower portion is elevated.

4. The method of claim 1 in which said lower portion of said at least one screen means is elevated by winding said upper portion about a horizontally extending support structure.

5. The method of claim 4 including guiding said edges of the at least one screen means vertically upwardly along the stanchions as the lower portion is elevated.

6. A porous groyne for shoreline and offshore reclamation comprising:

a plurality of spaced stanchions, at least one screen means supported between said stanchions, said screen means having an upper portion and a lower portion and having a plurality of openings therein through which water and some suspended solids may pass, means for supporting said screen means relative to said stanchions and elevating means for periodically elevating said lower portion of said screen means relative to said stanchions so that the lower portion thereof is maintained substantially at the height of newly deposited solid materials.

7. The porous groynes of claim 6 in which said elevating means includes at least one horizontal support member mounted between said stanchions, said upper portion of said screen means being secured to said support means, and drive means for rotating said support means to thereby wind said screen means about said support means.

8. The porous groyne of claim 7 in which said driving means includes locking means for retaining said lower portion of said screen means in an elevated position.

9. The porous groyne of claim 6 in which said elevating means includes at least one horizontal support member mounted between said stanchions, drive means for rotating said at least one said support member, and at least one funicular member connecting said support member to said bottom portion of said screen means whereby when said drive means rotates said at least one support member, said funicular member will be wound about said support member, thereby raising said lower portion of said screen means.

10. The porous groyne of claim 9 in which said driving means includes locking means for retaining said lower portion of said screen means in an elevated position.

11. The porous groyne of claim 9 in which said at least one support means includes at least one take-up reel mounted to a rod, said at least one funicular member being wound about said at least one take-up reel.

12. The porous groyne of claim 11 including guide means mounted about each of said spaced stanchions, said at least one funicular member having a first end portion mounted about a first take-up reel means and a second end portion mounted to a second take-up reel means and an intermediate portion extending through said guide means and along said lower portion of said screen means.

13. The porous groyne of claim 11 in which said driving means includes locking means for retaining said lower portion of said screen means in an elevated position.

14. The porous groyne of claim 6 including a pair of opposing channel members extending along said stanchions in opposite orientation with respect to one another, said screen means including a frame having opposite side frame elements, said opposite side frame elements being guided by said opposing channel members whereby said screen means may be vertically raised relative to said stanchions.

* * * * *